US011336069B2

(12) United States Patent
Ruesch

(10) Patent No.: US 11,336,069 B2
(45) Date of Patent: May 17, 2022

(54) SUPPLY DEVICE FROM SUPPLYING A MOBILE DEVICE WITH A MATERIAL AND MOBILE DEVICE

(71) Applicant: Cleanfix Reinigungssysteme AG, Henau (CH)

(72) Inventor: Felix Ruesch, Goldach (CH)

(73) Assignee: Cleanfix Reinigungssysteme AG, Henau (CH)

( * ) Notice: Subject to any disclaimer, the term of this patent is extended or adjusted under 35 U.S.C. 154(b) by 0 days.

(21) Appl. No.: 16/952,296

(22) Filed: Nov. 19, 2020

(65) Prior Publication Data

US 2021/0159657 A1 May 27, 2021

(30) Foreign Application Priority Data

Nov. 21, 2019 (EP) ..... 19210501

(51) Int. Cl.
*H01R 43/26* (2006.01)
*H01R 13/00* (2006.01)
(Continued)

(52) U.S. Cl.
CPC ..... *H01R 43/26* (2013.01); *H01R 13/005* (2013.01); *H01R 13/516* (2013.01); *H01R 13/639* (2013.01)

(58) Field of Classification Search
CPC ..... H01R 43/26; H01R 13/005; H01R 13/516
(Continued)

(56) References Cited

U.S. PATENT DOCUMENTS 3,642,036 A * 2/1972 Ginsburgh ..... B67D 7/0401 141/94
5,238,034 A * 8/1993 Corfitsen ..... B60K 15/04 141/346

(Continued)

FOREIGN PATENT DOCUMENTS

CN 204860064 12/2015
DE 202016104069 10/2017

(Continued)

*Primary Examiner* — Alexander Gilman
(74) *Attorney, Agent, or Firm* — Volpe Koenig

(57) ABSTRACT

A supply device for supplying a device that can be moved on a driving surface with a material supplied through a supply line. The supply device has a plug with an electric plug contact element that extends along a plug axis and is coupled to a plug receptacle of the mobile device by a linear joining movement, and a supply line with a valve, and detects a coupled state of the plug with the plug receptacle by an electric plug contact element. In the coupled state the valve is actuated. The supply device has a nozzle arranged on the supply line and is coupled to an inlet port of the mobile device. A feeding holder keeps the nozzle and the plug in a defined position and orientation relative to each other so that when coupling the plug to the plug receptacle the nozzle couples to the inlet port. The movement device makes the feeding holder with the plug and nozzle at least height adjustable and movable in the direction of the joining movement along a joining axis. The detection system determines a position of the plug receptacle. The supply device couples the plug to the plug receptacle and thereby the nozzle to the inlet port by a linear joining movement along the joining axis based on the determined position.

17 Claims, 5 Drawing Sheets

(51) Int. Cl.
*H01R 13/516* (2006.01)
*H01R 13/639* (2006.01)

(58) Field of Classification Search
USPC ..... 439/191
See application file for complete search history.

(56) References Cited

U.S. PATENT DOCUMENTS 5,671,786 A * 9/1997 Corfitsen ..... B25J 9/1679 141/231
6,085,805 A * 7/2000 Bates ..... B67D 7/145 141/192
6,269,848 B1 * 8/2001 Corfitsen ..... B67D 7/0401 141/94
6,354,343 B1 * 3/2002 Strnad ..... B67D 7/0401 141/94
6,619,342 B2 * 9/2003 Graham ..... B60L 53/16 141/231
6,691,749 B2 * 2/2004 Mulvenna ..... B60L 50/51 141/231
6,900,719 B2 * 5/2005 Roseman ..... B60R 25/04 340/5.22
7,891,387 B2 * 2/2011 Lim ..... A47L 9/2852 141/98
7,905,662 B2 * 3/2011 Fujita ..... G02B 6/423 385/53

FOREIGN PATENT DOCUMENTS

| | | |
|---|---|---|
| EP | 1762165 | 3/2007 |
| KR | 20140036653 | 3/2014 |
| WO | 2017190784 | 11/2017 |

* cited by examiner

SUPPLY DEVICE FROM SUPPLYING A MOBILE DEVICE WITH A MATERIAL AND MOBILE DEVICE

INCORPORATION BY REFERENCE

The following documents are incorporated herein by reference as if fully set forth: European Patent Application No. 19210501.3, filed Nov. 21, 2019.

TECHNICAL FIELD

The invention relates to a supply device for supplying a mobile device with a material that can be supplied through a supply line, a mobile device which can be supplied via the supply device and a system having the supply device and the mobile device.

BACKGROUND

Automated guided vehicles (AGV), such as self-propelled wet cleaning robots, processing machines, delivery devices or transport vehicles, etc. are used in a wide range of areas. In order for such AGVs to be used optimally, the phases of autonomous operation should be as long-lasting as possible. Sometimes decisive for the achievable duration of such a phase is the depletion characteristic of the AGVs. In this context, solutions with fixed-position docking stations for feeding a consumable material are known. The AGV can couple to the docking station by itself. Depending on the type of AGV, the autonomous operation is limited by the fact that refilling a consumable material by such a docking station is not expedient and therefore requires manual steps. For example, an AGV can be used to transport consumable material or requires consumable material to successfully fulfil its task. An autonomously operated cleaning or floor treatment robot consumes material in operation, for example water and/or cleaning fluid. In order for such a cleaning or floor treatment robot to be operated autonomously for as long as possible, an autonomous supply of at least water is decisive.

Usually, for supplying AGVs with required material, be it electricity or also fluid-based material or material with flow properties, such as for example water or an emulsion or a bulk material, systems are used in which the AGV cooperates with a fixed docking station. In such systems, the AGV steers to the docking station as soon as appropriate material is needed and uses its drive to couple to the docking station in a coupled state. An example of such a system for floor treatment is described in WO2017/190784. The system has a floor treatment robot and a fixed docking station. In this case, connection elements are arranged at a specific position on the floor treatment robot and at a corresponding position on the docking station. For coupling, the cleaning robot moves on the installation surface or the driving surface and positions itself in front of the docking station. After pre-positioning is completed, the actual coupling movement takes place by the cleaning robot approaching in a direction parallel to the installation surface until stopping at the docking station. For a successful coupling, it is imperative that the connection elements are parallel to the installation surface. To achieve this, the corresponding connection elements must be horizontally aligned at the same height and precisely matched to each other. The height and horizontal alignment of the connection elements on the docking station necessarily determine the position and orientation of the corresponding connection elements on the cleaning robot or vice versa.

SUMMARY

It is the object of the present invention to provide a supply device and a mobile device which are less restricted in design and interaction and at the same time allow simpler and safer coupling.

This objective is achieved by one or more features described herein, wherein advantageous or specific embodiments for achieving the object are described below and in the claims.

In a first inventive step it is realized that in conventional systems that use a docking station to feed a mobile device it is highly restrictive that the docking station can only interact with a single specific and predefined arrangement of connection elements on the mobile device with a horizontal coupling direction. In practice this means that for different arrangements of the connection elements on mobile devices, correspondingly different docking stations must be used, even if the same material is delivered in the final result. Furthermore, the horizontal coupling direction specified at known docking stations when supplying material, especially for liquids, can place high demands on the sealing if an undesirable leak is to be reliably prevented.

In a further inventive step, it is recognized that in conventional systems that use a docking station to feed a mobile device, it is a difficult problem to guarantee for safety purposes that objects or, for example, children that are between the mobile device and the docking station unforeseen, are not crushed during coupling. This seems to be particularly relevant for systems in which the mobile device has a considerable mass and therefore correspondingly high forces act during the coupling movement. Even for rare damage, there are undesirable liability questions.

The present invention thus relates to a supply device for supplying a device that can be moved on a driving surface with a material that can be supplied through a supply line, in particular a pipeline. The supply device also includes a plug with at least one electric plug contact element, which extends to the free end of the plug along a plug axis and can be coupled to a plug receptacle of the mobile device by a linear joining movement. The supply device also includes a supply line with a valve and detects a coupled state of the plug with the plug receptacle using an electric plug contact element. In the coupled state, the valve of the supply line can be actuated. The supply device comprises a nozzle, a feeding holder, a movement device, and a detection system, wherein the nozzle is arranged on the supply line and extends towards the free nozzle end along a nozzle axis and can be coupled to an inlet port of the mobile device. The feeding holder keeps the nozzle and the plug in a defined position and orientation relative to each other so that when coupling the plug to the plug receptacle the nozzle couples to the inlet port. The movement device makes the feeding holder with the plug and nozzle at least height adjustable and movable in the joining movement direction along a joining axis. A detection system is configured to determine a position and orientation of the plug holder based on the detection features of the plug receptacle. For this purpose, the supply device is designed, based on the determined position and orientation of the plug receptacle, to couple the plug to the plug receptacle by a linear joining movement along the joining axis and thereby to couple the nozzle to the inlet port.

An advantage of the supply device according to the invention results from the fact that the nozzle and the plug are held by the feeding holder in a certain position and orientation relative to each other and the feeding holder can be moved by the movement device. Thus, the supply device according to the invention allows the supply of mobile devices, which is less limited to the extent that the same supply device can be used for different devices with different arrangements of the connection elements on the device, for example at different heights. In this case, movability of the plug and nozzle connection elements is provided by the movement device. In an advantageous embodiment the movement device can provide movability of the connection elements in three different directions (translational degrees of freedom) and around one or optionally two rotational axes (rotational degrees of freedom). The translational degrees of freedom allow the plug and nozzle to be movable in height relative to a driving surface on which the mobile device travels and in a plane parallel to the driving surface. The rotational degrees of freedom allow movement of the connection elements around a rotation axis, which runs parallel to the driving surface or if necessary stands perpendicular to the driving surface. Mobility around a rotation axis running parallel to the driving surface allows inclination of the plug and nozzle towards the driving surface. This makes it possible for the supply device to couple the plug and the nozzle to the corresponding plug receptacle and the corresponding inlet port, regardless of their height and orientation on the mobile device. With the adjustable inclination, for example, when feeding liquid, complex seals can be dispensed with and an undesirable leak can be prevented.

A further advantage of the supply device according to the invention results from the fact that the movement necessary for coupling is carried out by the movement device and thus by the movement of the feeding holder with the connection elements. This allows a more reliable coupling movement compared to systems with a docking station, since the coupling movement is carried out by the movement device and thus by the movement of the nozzle and plug connection elements. Due to the low moving mass compared to that of a mobile device, for example of a cleaning robot, the coupling process or the coupling movement can be controlled and in particular by the use of smaller forces. This prevents the crushing of objects that are located between the connection elements to be coupled.

The supply device according to the invention can, for example, be used to supply a mobile device as a consumer with fluid-based material or material with flow properties as a consumable material through the supply line and the nozzle. The nozzle is formed as the end piece of the supply line and is used for coupling to the inlet port, so that fluid-based material or material with flow properties can be supplied to the mobile device through the supply line and the nozzle. Likewise, the supply device according to the invention can be used if required exclusively for fluid-based material or material with flow properties, exclusively for electric current, for example for charging a battery, and also to supply the mobile device with a fluid-based material/material with flow properties simultaneously with electric current.

The plug of the supply device can advantageously be a power plug which is designed to supply current and for this purpose, for example, has male plug contact elements. These male plug contact elements, for example contact pins, can be surrounded by a sleeve-shaped protective cover, so that the contact pins are not freely accessible for contact for safety reasons. The counterpart to the plug of the supply device is located on the mobile device and is formed by the plug receptacle. In this case, the electric plug receptacle contact elements of the plug receptacle form recesses, into which the electric plug contact elements of the plug are inserted. Also conceivable is an arrangement in which the plug and the plug receptacle are interchanged, for example the plug is arranged on the mobile device and the plug receptacle is arranged on the supply device. The linear joining movement relates to plugging the plug into the plug receptacle and the coupled state to the state in which the plug is plugged into the plug receptacle as far as it will go. The linear joining movement is decisively determined by the guide wall of the plug and that of the plug receptacle.

The plug receptacle, which is attached to the mobile device, typically has female plug receptacle contact elements corresponding to the male plug contact elements of the plug. The female plug receptacle contact elements can then be recognition features of the plug receptacle, since due to their position and orientation relative to each other these make a position and orientation of the plug receptacle that is recognizable to the detection system.

The detection system can advantageously be based on principles of image acquisition and image recognition, wherein a position and orientation of the plug receptacle are determined on the basis of recognition features detected in recorded images.

The supply line of the supply device may be in the form of a tube or a hose, wherein fluid-based material or material with flow properties can be supplied through the supply line to the mobile device and an end of the supply line is formed by the nozzle. The other end of the supply line can then be connected, for example, to a permanently installed material supply system (water supply of a building) or a material storage tank. The supply line has a valve, for example actuated by the supply device. In the simplest case, the valve can adopt an open position and a closed position, wherein it can be changed between the positions. In the open position, the material can be supplied through the supply line and this is prevented in the closed position. The valve is preferably located in the area of the feeding holder at which the nozzle is held.

The supply device can detect a coupled state, for example in that contact is made between an electric plug contact element of the plug and an electric plug receptacle contact element of the plug receptacle, wherein making a contact between the contact elements is only possible in the coupled state.

The nozzle forms the end piece of the supply line and is inserted into the inlet port. The nozzle and the inlet port are in a coupled state when the plug and the plug receptacle are in a coupled state. In the coupled state, the nozzle is inserted into the inlet port and a fluid connection for feeding a material via the supply line is produced. The nozzle may optionally also have one or more seals, which allow a tighter or more form-fitting coupling of the nozzle and the inlet port.

The feeding holder is formed according to the invention so that it holds the plug and the nozzle so that when coupling the plug to the plug receptacle the nozzle is introduced into the inlet port and so that the coupling of the plug to the plug receptacle is accompanied by the coupling of the nozzle to the inlet port.

The movement device can be advantageously formed by a robot arm, which is height-adjustably attached to a base plate and has at least one arm segment. The arm segment is then attached to the base plate so as to be pivotable around a rotation axis, wherein in the case of multiple arm segments these are each pivotally connected to each other around a rotation axis. The feeding holder may advantageously be attached to an outermost area of an arm segment so as to be pivotable or rotatable around at least two mutually orthogonally arranged rotation axes.

The supply device is designed according to the invention to determine the position and orientation of the plug receptacle by the detection system. Based on this, the movement device allows a linear movement of the feeding holder along the joining axis for coupling the plug to the plug receptacle, whereby the coupling of the nozzle to the inlet port accompanies this.

The supply device has a controller for the semi-automatic or fully automatic movement of the feeding holder. The controller is connected to drive units, which automatically provide the rotatability or pivotability of the feeding holder by a control line. Likewise, the controller is communicatively connected to the detection system for detecting a position and orientation of the plug receptacle. In this case, the valve of the supply line is also connected via a control line to the controller of the supply device for the actuation thereof. Furthermore, the plug may be designed to enable a communicative connection to a controller of the mobile device in the coupled state via one or more electric plug contact elements, so that the controller of the supply device can interact with the controller of the mobile device in the context of supplying the mobile device.

According to a specific embodiment of the supply device, the feeding holder can hold the nozzle and the plug with parallel alignment of the nozzle axis to the plug axis.

According to a further embodiment of the supply device, it is particularly advantageous in the event of parallel alignment of the nozzle axis to the plug axis if the joining axis is inclined to the driving surface of the mobile device in the direction of the joining motion, in particular at an inclination angle in the range from 12° to 32°. An inclination angle of about 22° is particularly advantageous here. This inclined alignment of the joining axis simplifies the supply of the mobile device with a fluid-like material, for example, in such a way that the requirements for a form-fitting coupling of the nozzle to the inlet port are reduced and a return flow of the fluid-like material from the inlet port back into the nozzle or into the environment is prevented.

According to a further specific embodiment, the supply device is configured to determine the joining axis based on the determined position and orientation of the plug receptacle, wherein the movement device is designed to make the feeding holder with the plug and nozzle movable along the determined joining axis. For example, based on the recognition of the recognition features of the plug receptacle in a recorded image and the known design of this plug receptacle, the orientation of the plug receptacle to the mobile device can be inferred. Based on the orientation thus determined, the joining axis can then be determined. This allows the plug and the nozzle of the same supply device to be coupled to plug receptacles and inlet ports that are attached to respective mobile devices with different orientations.

According to a further embodiment, the free ends of the plug and nozzle are arranged with an offset relative to each other in the direction of the joining axis. The offset corresponds to an offset in the direction of the joining axis between the free ends of the plug receptacle and the inlet port on the mobile device.

According to a further specific embodiment, a locking device is arranged on the plug for electromechanical locking of a coupled state of the plug to the plug receptacle, wherein the supply device makes the valve of the supply line actuatable with the plug locked. The locking device can have a drive which is designed to insert locking elements, for example pins, in designated locking element receptacles, for example recesses, arranged on the plug receptacle. The locking device can only be activated when the plug is coupled to the plug receptacle. This allows the valve for supplying the material to be opened only when the plug is coupled to the plug receptacle and locked. This can increase safety to such an extent that the material is supplied only in the coupled state and that no undesirable decoupling of the nozzle occurs during the supply of the material. The locking device and the locking elements can alternatively also be arranged on the plug receptacle, wherein the locking element receptacles are arranged on the plug.

According to a particularly advantageous embodiment of the supply device, the movement device is designed to make the feeding holder with the plug and nozzle partially or fully automatically movable in a limited motion mode and an unlimited motion mode, and the supply device is configured to couple the plug to the plug receptacle by a movement of the plug into a pre-position relative to the plug receptacle in the limited motion mode and a linear joining motion of the plug in the unlimited motion mode. The limited motion mode relates to a motion mode in which the feeding holder is moved with greatly reduced dynamics and/or force. A threshold may be set for the maximum applicable force for the movement of the feeding holder. In this case, for example, contact with a moving element of the supply device leads to blocking of the movement device, so that no increased forces, i.e. forces higher than the set threshold, can act on the contacting object. Consequently, there is no risk to the user, people, or animals during the autonomous operation of the supply device. The unlimited motion mode relates to a motion mode in which the feeding holder and thus the plug and the nozzle are moved with increased force compared to the limited motion mode. For example, the plug can then be coupled to the plug receptacle in the unlimited motion mode.

According to a specific embodiment of the supply device, the movement device has a joining device with a linear drive, the feeding holder is connected to the joining device, and the supply device is designed to couple the plug to the plug receptacle and the nozzle to the inlet port based on a movement caused by the linear drive in the unlimited motion mode.

According to a further specific embodiment of the supply device, the detection system is arranged on the movement device, has a camera, and makes the position and orientation of the plug receptacle determinable by image recognition and evaluation algorithms based on at least two electric plug receptacle contact elements of the plug receptacle as recognition features.

The invention also relates to a device that can be moved on a driving surface, which can be supplied by a described supply device with a material that can be supplied through a supply line, in particular a pipeline. The mobile device comprises a plug receptacle, which extends from the free plug receptacle end along a plug receptacle axis and can be coupled to a plug of the supply device by a linear joining movement of the plug along a joining axis. The plug receptacle comprises at least one electric plug receptacle contact element and at least one recognition feature for a detection system of the supply device. The mobile device comprises an inlet port with inlet opening which extends from the inlet opening along an inlet port axis and which is coupled to the nozzle of the supply device and an inlet holder. The inlet holder holds the plug receptacle 20 and the inlet port 22 in a defined position and orientation relative to each other so that when coupling the plug receptacle 20 to the plug 4 the inlet port 22 couples to the nozzle 5. The inlet holder is arranged on the mobile device so that the joining axis 17 is inclined in the direction of the joining movement 16 to a driving surface on which the mobile device stands, in particular at an inclination angle 19 in the range from 12° to 32°. The mobile device detects a coupled state of the plug receptacle with the plug by an electric plug receptacle contact element and based thereon enables the actuation of a valve of a supply line of the supply device by the mobile device.

In this case, the inlet holder holds the plug receptacle and the inlet port in such a way that the position and orientation thereof defined relative to each other corresponds to the position and alignment of the plug and nozzle defined relative to each other. This mutually corresponding relative arrangement of plug, nozzle, plug receptacle and inlet port causes a simultaneous engagement of the plug and plug receptacle and the nozzle and inlet port to take place when coupling by the movement of the plug and the nozzle. This makes it possible to infer a coupled state of the nozzle with the plug receptacle on the basis of a coupled state of the nozzle with the inlet port. Likewise, this makes it possible that safety-relevant states, which can be detected when coupling the plug to the plug receptacle, are equally safety-relevant with regard to the coupling of the nozzle and inlet ports.

The plug receptacle may be connected to the drive energy storage device of the mobile device and may also have a communicative connection to the controller of the mobile device. Via such a communicative connection, the mobile device can detect, for example, a coupled state of the plug receptacle with the plug. Similarly, it may be possible for the mobile device to actuate the valve of the supply line in the coupled state. The floor treatment robot can also have a level sensor system, which displays levels of consumables to the controller such as electric current and/or fresh floor treatment fluid.

The inlet port of the mobile device is connected to a storage container for the feedable material and may also have, if necessary, one or more seals, which enables a tighter or more form-fitting coupling of the nozzle and the inlet port.

According to a specific embodiment of the mobile device, the inlet holder holds the plug receptacle and the inlet port with parallel alignment of the plug receptacle axis to the inlet port axis.

According to a further specific embodiment, the free ends of the plug receptacle and the inlet port are arranged with an offset to each other in the direction of the joining axis, wherein the offset corresponds to an offset in the direction of the joining axis between the free ends of the plug and the nozzle on the supply device. As a result, structural restrictions on the part of the mobile device can be compensated by the arrangement of the plug, nozzle, plug receptacle and inlet port.

According to a further specific embodiment, at least one locking element is arranged on the plug receptacle for a locking device of the plug of the supply device for locking a coupled state of the plug receptacle with the plug. In this case, the valve of the supply line can be actuated by the mobile device when the plug is locked.

According to a particularly advantageous embodiment of the mobile device, this can be a floor treatment robot. The floor treatment robot may be designed to treat at least parts of the surface with fresh floor treatment liquid, for example cleaning fluid, in autonomous mode, wherein the used floor treatment fluid is optionally picked up again or absorbed by the floor treatment robot. Such a floor treatment robot can then be supplied autonomously by a supply device according to the invention with fresh floor treatment fluid and for example electric current.

A preferred form of such a floor treatment robot has at least one brush for floor treatment, a cleaning liquid supply for supplying the cleaning fluid from a tank to the brush and thus to the floor and a suction arrangement assigned to the damp floor area. At least one tank and at least one pump are provided for the cleaning liquid. Preferably, there is a tank for cleaning liquid, or water with detergent, and a tank for the cleaning agent, which is added to the water. The drive device comprises at least one battery and at least one drive motor. The controller comprises a display and input device, preferably a touch screen. Floor treatment robots can also be regarded as ground treatment machines, which perform a ground treatment outdoors and use a fluid-based material or a material with flow properties, for example for fertilization or sowing, or such consumables.

The invention also relates to a system with a supply device and a mobile device, wherein the mobile device is supplied by the supply device with a material which can be fed through the supply line, in particular a pipeline, and which has a level sensor system which provides at least one piece of level information of the feedable material, wherein in the event of a provided piece of level information in a predetermined range the mobile device can be autonomously moved to the supply device, where the plug of the supply device can be moved to the plug receptacle of the mobile device, the nozzle is coupled to the inlet port by coupling the plug to the plug receptacle, and the actuation of the valve is initiated by the mobile device based on the detection of the coupled state of the plug receptacle with the plug. If necessary, only one rechargeable battery or one accumulator will be charged.

The driverless and autonomously controlled device may be, for example, the described floor treatment robot or a floor cleaning robot, to which the location of the supply device is known. The level sensor system can indicate to this floor treatment robot the level of the fresh floor treatment liquid as level information, wherein if the indicated level is in a predetermined range, the cleaning robot autonomously steers to the supply device. If the floor treatment robot is located at the supply device, the floor treatment robot can, for example, communicate its location or presence via a wireless communicative connection to the supply device. Subsequently, the plug and the nozzle can be moved to the floor treatment robot by the movement device of the supply device and based on the determined position and orientation of the plug receptacle the plug is coupled to the plug receptacle and the nozzle is coupled to the inlet port. After detection of the coupled state of the plug with the plug receptacle, the valve of the supply line can be made actuatable by the supply device and the actuation of the valve by the floor treatment robot can take place. As a result, the floor treatment robot or the cleaning robot is supplied with the feedable material, for example fresh floor treatment liquid or cleaning fluid and/or with electricity. The amount to be delivered can be determined and monitored by the level sensor system or based on the level information. The floor treatment robot can advantageously be designed to drain off the consumed floor treatment liquid before supplying.

According to an alternative concept, the plug can take the place of the plug receptacle and the plug receptacle can take the place of the plug, i.e. the plug and the plug receptacle can be interchanged and used in that arrangement.

BRIEF DESCRIPTION OF THE DRAWINGS

Purely by way of example, preferred embodiments of the supply device, the mobile device and the system are described below with reference to the listed figures. In the figures.

DETAILED DESCRIPTION

Figure 1:
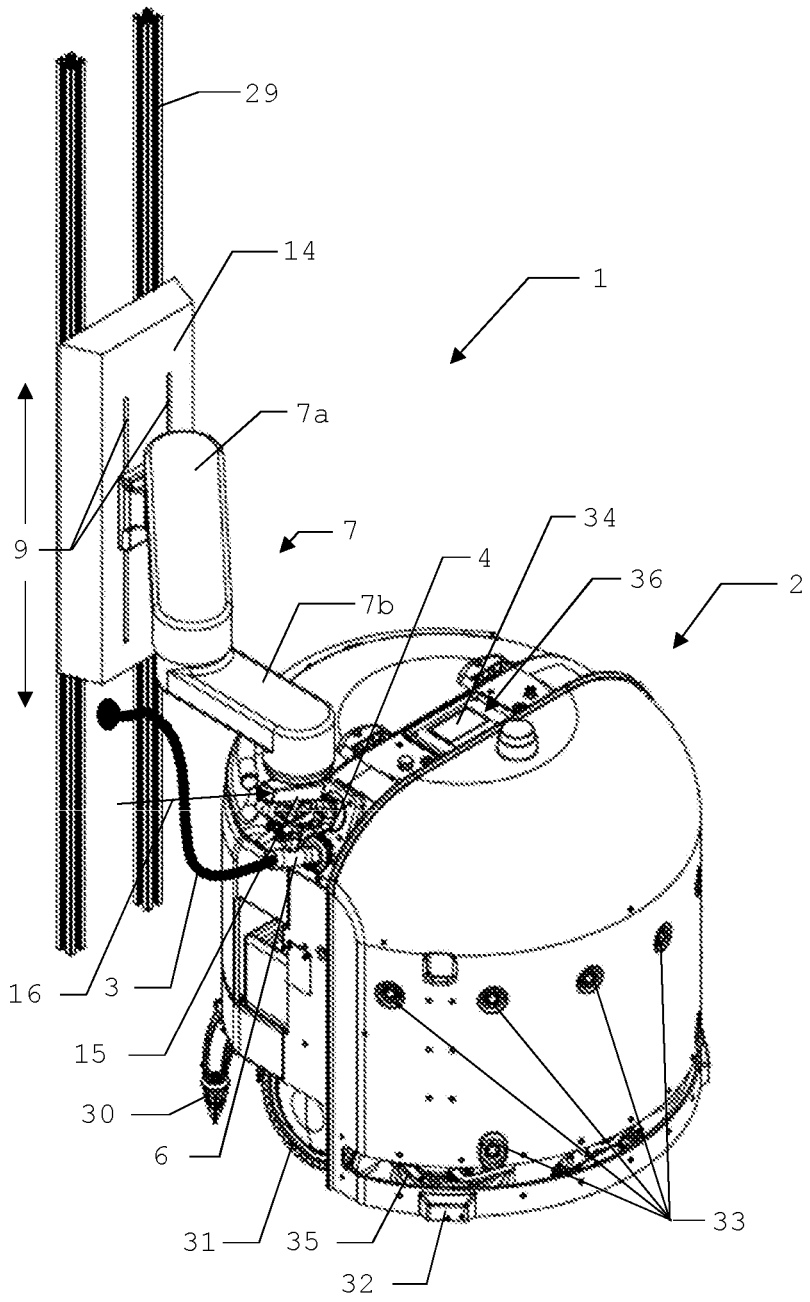
FIG. 1 shows a perspective representation of a system with a supply device and a mobile device in the form of a cleaning robot.

FIG. 1 shows as an example a system with a supply device 1 for supplying a mobile device 2 in the form of a floor treatment robot, which is designed to clean the floor with a cleaning liquid and to soak up the cleaning liquid applied to it. The floor treatment robot 2 has two drive wheels 31, two pivoting support wheels, a drive device with one motor per drive wheel 31 and a controller 36 with a display and input device 34 in the form of a touch screen. The floor treatment robot 2 comprises two interchangeable cleaning brushes 35 or pads rotatable around laterally offset vertical axes. The brushes 35 are rotated by a brush drive. With a cleaning liquid supply that is not shown, cleaning fluid is supplied from a first tank in the area of the brushes by a pump. Cleaning agent can be introduced into the cleaning liquid from a second tank. After the floor treatment by the brushes 35, the cleaning fluid left on the floor is sucked up by a suction arrangement 30 and delivered to the first tank. The electrical energy of all electrically operated components comes from at least one rechargeable battery 26, which can be supplied with electric current via the plug receptacle 20 and the plug 4. The suction arrangement 30 is preferably arranged on the chassis so as to be slightly pivotable by a tracking connection, so that the suction arrangement 30 is always assigned to the damp floor area even during cornering. Because the brushes 35 are slightly offset to one side with respect to a central axis in the direction of travel of the floor treatment robot, the cleaning on this side is essentially carried out up to the area with the drive wheel 31. In order to ensure that the drive effect of the drive wheel 31 is not affected by the cleaning fluid, a scraper deflects the cleaning fluid towards the center of the floor treatment robot. In order to detect obstacles or boundaries, sensors for obstacle detection are preferably used. In the embodiment shown, multiple ultrasonic sensors 33 are arranged in the front area of the housing, wherein the arrangement of the ultrasonic sensors at two different heights ensures good detection of obstacles. Obstacles in the floor, in particular steps, are detected with two infrared sensors 32 arranged on the side at the front and directed towards the floor. For obstacle detection, at least one contact sensor in the form of a deflection sensor is also provided, which is arranged between the chassis and a housing area which is in front in the direction of travel. Now, when an obstacle comes into contact with the front housing area, the housing area is deflected relative to the chassis by the obstacle, which the deflection sensor detects.

The movement device 7 shown in FIG. 1 comprises a fixed installable base plate 14, which can be mounted, for example, on a wall or as shown on a column profile construction 29. The base plate 14 has guide rails 9 in which a first swivel joint is guided height-adjustably. By this first swivel joint, a first arm segment 7*a* of the movement device is connected to the base plate in such a way that the arm segment 7*a* is height-adjustable and can be pivoted in a horizontal plane around the axis of rotation of the swivel joint. On the first arm segment 7*a*, a further arm segment 7*b* of the movement device is attached via a second swivel joint, wherein the second arm segment 7*b* is again pivotable in a horizontal plane around the axis of rotation of the second swivel joint. At the free extremity of the second arm segment 7*b* there is a third swivel joint by which the feeding holder 6 is connected to the movement device. The third swivel joint provides at least a tiltability of the feeding holder 6 towards the driving surface 18 of the mobile device 2. The embodiment of the movement device 7 shown in FIG. 1 has a joining device 15 with a linear drive. In this case, the plug 4 is connected to the joining device 15 by the feeding holder 6. The detection system 8 is attached to the joining device 15, wherein the detection field of view 41 of the detection system is oriented in the direction of the joining motion 16. The supply device also has a controller which is connected to drive units of the movement devices. In this case, the drive units of the movement device provide the mobility of the feeding holder and thus of the plug and the nozzle. The controller is also connected to the detection system 8, so that the coupling of the plug 4 to a plug receptacle 20 of a mobile device can be carried out automatically.

Figure 2:
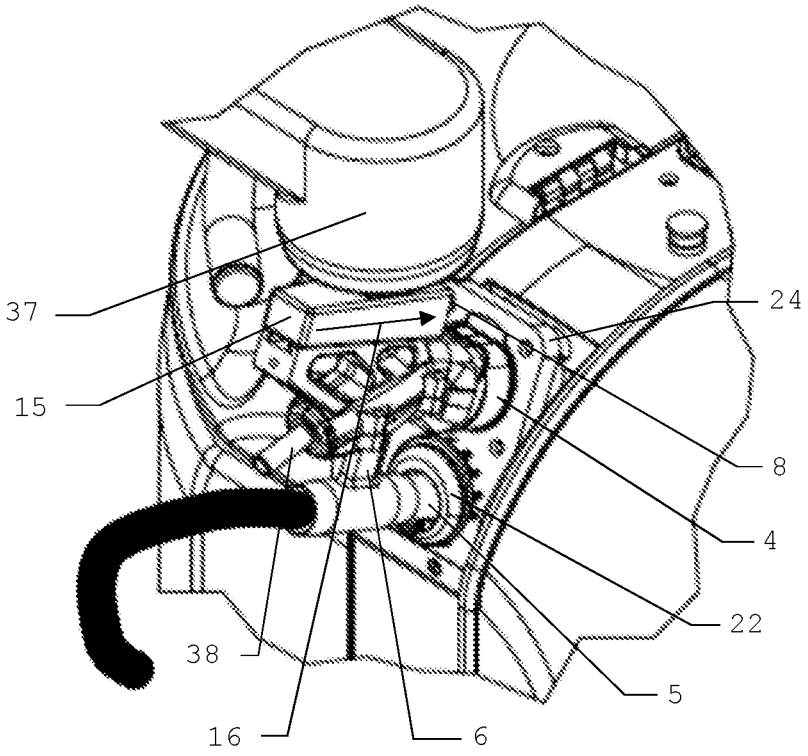
FIG. 2 shows in an excerpt from FIG. 1 an enlarged perspective representation of a part of the supply device and the mobile device.

FIG. 2 shows an excerpt from FIG. 1 in an enlarged view. At the free end 37 of the second arm segment 7*b*, the joining device 15 with linear drive is connected to the movement device 7 via the third swivel joint. The feeding holder 6 is connected to the joining device and holds the plug 4 and the nozzle 5 in a defined position and orientation relative to each other. Due to the movement device, the feeding holder 6 can be tilted towards the floor. The plug 4 is connected to a power source via an electric cable 38.

Figure 3:
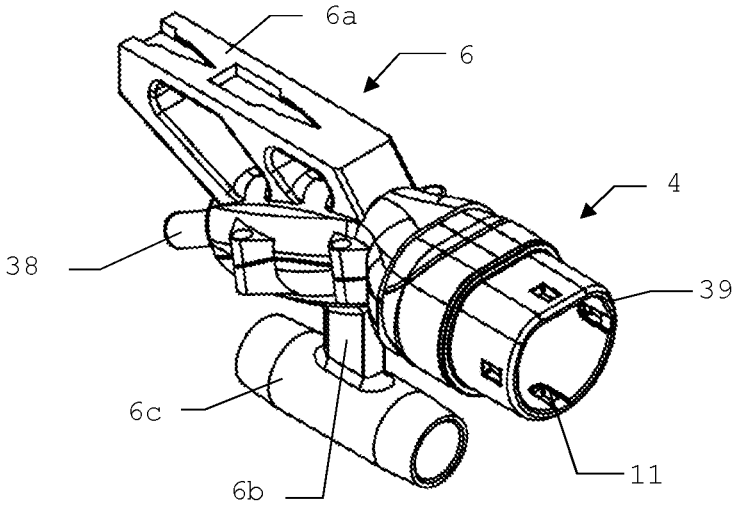
FIG. 3 shows a perspective representation of a plug with a holder.
Figure 4:
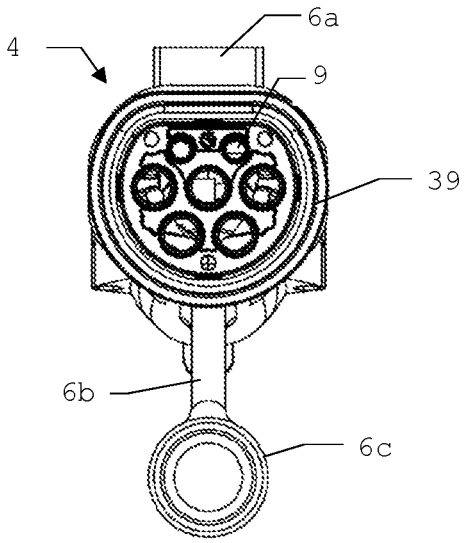
FIG. 4 shows a frontal view of the plug with the holder of FIG. 3.
Figure 5:
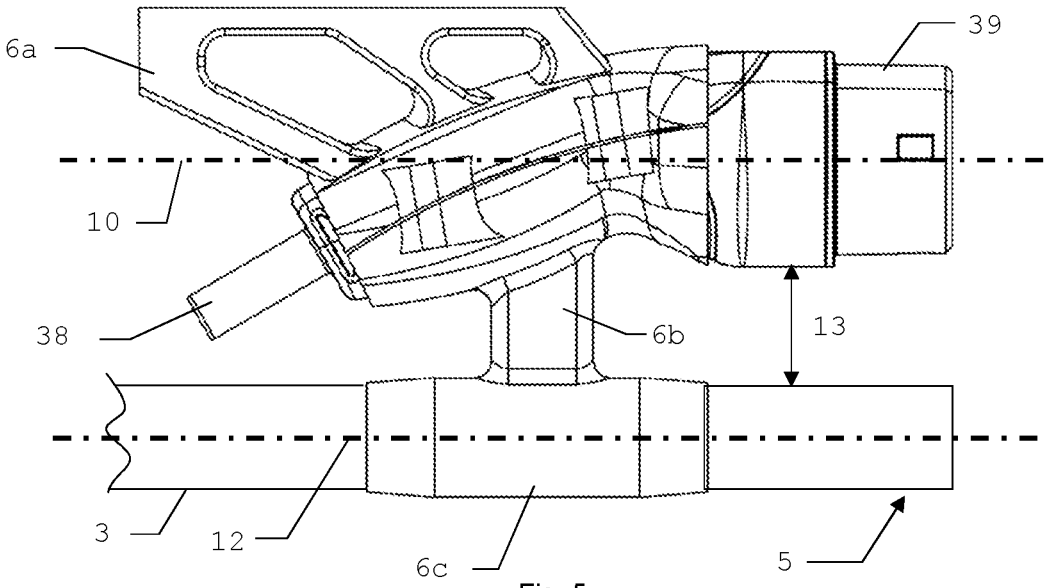
FIG. 5 shows a side view of the plug with the holder of FIG. 2 or 3 with a supply line and a nozzle.

FIGS. 3, 4 and 5 show an embodiment of the plug 4, the nozzle 5 and the feeding holder 6. The plug 4 has at least one electric plug contact element 9 and extends to the free plug end along a plug axis 10. The electrical contact element is typically pin-shaped and can additionally be surrounded by a sleeve-shaped protective device which is open to the free end of the plug. The linear joining movement 16 for coupling the plug to the plug receptacle is also determined by the guide wall 39 of the plug. Arranged on the guide wall 39, the plug has 4 locking elements 11 for a locking device of the plug, which allow locking of a coupled state. The nozzle 5 extends to the free nozzle end along a nozzle axis 12. The feeding holder 6 is designed to hold the nozzle 5 and the plug 4 in a defined position and orientation relative to each other. The embodiment of the feeding holder shown in FIG. 2 holds the plug and the nozzle in a plane perpendicular to the plug axis and spaced apart from each other and so that the plug axis 10 runs parallel to the nozzle axis 12. The holder shown comprises a first holding part 6*a*, which can be connected to the joining device 15 and which holds the plug 4, a second holding part 6*c*, which is pipe-shaped and is used to accept the nozzle, which is arranged on the supply line, and a third holding part 6*b*, which forms a connecting bar, which connects the first and the second holding parts to each other so that the plug and the nozzle are held in a defined position and orientation relative to each other. The distance 13 is matched to the dimensioning of the plug receptacle corresponding to the plug and the inlet port. There is no offset between the free plug end and the free nozzle end in the direction of the joining axis. Preferably, the valve of the supply line is arranged in the area of the second holding part 6*c* and is connected to the controller of the movement device via a control line that passes through the third holding part 6*b*.

Figure 6:
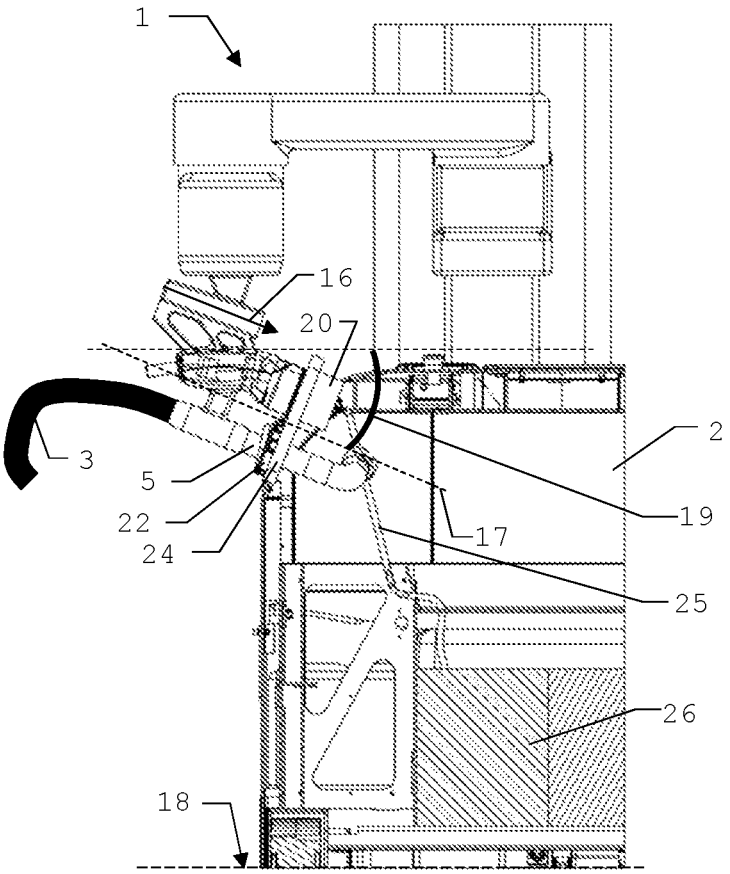
FIG. 6 shows a side view of the system of FIG. 1.
Figure 7:
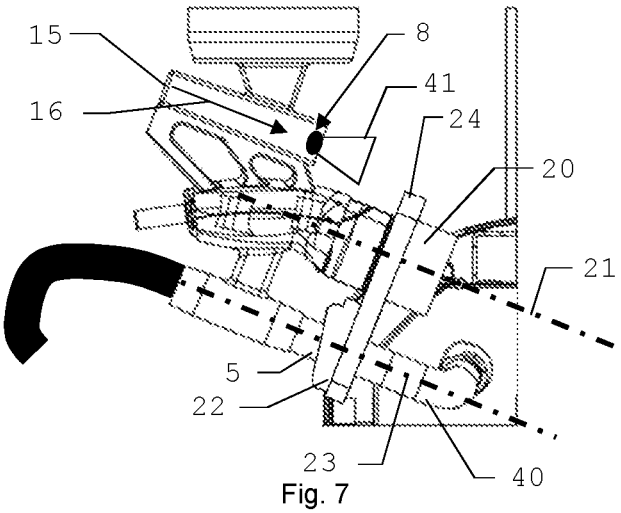
FIG. 7 shows in an excerpt from FIG. 6 an enlarged side view of a coupled state of a plug, plug receptacle, nozzle and inlet port with a joining device and a detection system.

FIG. 6 shows a device 2 which can be moved on a driving surface 18 in the form of a floor treatment robot, which is supplied by a supply device 1 according to the invention with a material that can be fed through a supply line 3. In this case, the mobile device has a plug receptacle 20, which extends from the free plug receptacle end along the plug receptacle axis 21 and which can be coupled to the plug 4 by a linear joining motion 16 of the plug 4 along a joining axis 17. The plug receptacle 20 of the embodiment of the mobile device 2 shown in FIG. 6 is connected via a charging cable 25 to the rechargeable battery 26 of the mobile device. Likewise, the plug receptacle 20 is connected to the controller of the mobile device. The mobile device has an inlet port 22 with an inlet opening which extends from the inlet opening along an inlet port axis 23 and which can be coupled to the nozzle 6. The inlet port is connected to a tank for fresh floor treatment liquid via a hose-shaped or a tubular connection 40. The embodiment of the inlet holder 24 shown in FIG. 6 holds the plug receptacle 20 and the inlet port 22 in a plane perpendicular to the plug receptacle axis 21 and spaced apart from each other and so that the plug receptacle axis 21 runs parallel to the inlet port axis 23. In this case, the inlet holder 24 is arranged on the mobile device so that the joining axis 17 is inclined to the driving surface 18 at an inclination angle 19 of around 22°. A detection system 8 is arranged on the joining device 15. The detection system has a camera with a detection field of view 41 that is oriented in the direction of the joining motion.

Figure 8:
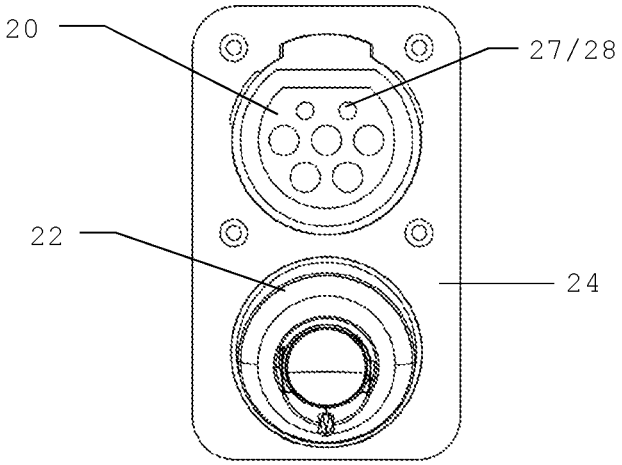
FIG. 8 shows a frontal view of a plug receptacle, an inlet port, and an inlet holder.

FIG. 8 shows an embodiment of the plug receptacle 20, the filling nozzle 22 and the inlet holder 24. The plug receptacle has at least one electric plug receptacle contact element 27. Likewise, the plug receptacle has at least two recognition features 28 for the detection system 8 of the supply device 1. If the plug receptacle contact element 27 is used as a recognition feature 28, then the edges of the hole of the plug receptacle contact element make orientation of the plug receptacle recognizable for the detection system 8.

The invention claimed is:

1. A supply device (1) for supplying a mobile device (2) that can be moved on a driving surface with a material, the supply device comprising:

a plug (4) with at least one electric plug contact element (9), which extends towards a free end of the plug along a plug axis (10) and which is adapted to be coupled to a plug receptacle (20) of the mobile device (2) by a linear joining movement (16);

a supply line (3) with a valve;

a nozzle (5) arranged on the supply line (3) that extends towards a free nozzle end along a nozzle axis (12) and is couplable to an inlet port (22) of the mobile device (2);

a feeding holder (6) holds the nozzle (5) and the plug (4) in a defined position and orientation relative to each other so that during coupling of the plug (4) to the plug receptacle (20), the nozzle (5) couples to the inlet port (22);

a movement device (7) that makes the feeding holder (6) with the plug (4) and nozzle (5) at least height adjustable (9) and movable along a joining axis (17) in a direction of the joining movement (16);

a detection system (8) configured to detect a position and orientation of the plug receptacle (20) based on recognition features (28) of the plug receptacle (20);

the supply device (1) is configured based on a determined position and orientation of the plug receptacle (20) to couple the plug (4) to the plug receptacle (20) by the linear joining movement (16) along the joining axis (17) and thereby to couple the nozzle (5) to the inlet port (22); and wherein the supply device (1) is configured to detect a coupled state of the plug (4) with the plug receptacle by the electric plug contact element and based thereon makes the valve of the supply line (3) actuatable.

2. The supply device as claimed in claim 1, wherein the feeding holder (6) holds the nozzle (5) and the plug (4) with parallel alignment of the nozzle axis (12) to the plug axis (10).

3. The supply device as claimed in claim 1, wherein the joining axis (17) is inclined to a driving surface (18) of the mobile device (2) in a direction of the joining movement (16).

4. The supply device as claimed in claim 1, wherein the supply device (1) is configured to determine the joining axis (17) based on a determined position and orientation of the plug receptacle (20) and the movement device (7) is configured to make the feeding holder (6) with the plug (4) and the nozzle (5) movable along the determined joining axis (17).

5. The supply device as claimed in claim 1, wherein the free ends of the plug (4) and the nozzle (5) are arranged with an offset to each other in a direction of the joining axis (17), and the offset corresponds to an offset in the direction of the joining axis (17) between the free ends of the plug receptacle (20) and the inlet port (22) on the mobile device (2).

6. The supply device as claimed in claim 1, wherein a locking device is arranged on the plug for electromechanical locking of a coupled state of the plug (4) with the plug receptacle (20), and the supply device (1) makes the valve of the supply line (3) actuatable when the plug is locked.

7. The supply device according to claim 1, wherein the movement device (7) is configured to make the feeding holder (6) with the plug (4) and the nozzle (5) partially or fully automatically movable in a limited motion mode and an unlimited motion mode, and the supply device (1) is configured to couple the plug (4) to the plug receptacle (20) by a movement of the plug (4) into a preposition relative to the plug receptacle (20) in the limited motion mode and a linear joining motion (16) of the plug (4) in the unlimited motion mode.

8. The supply device as claimed in claim 7, wherein the movement device (7) has a joining device (15) with a linear drive, the feeding holder (6) is connected to the joining device (15), and the supply device (1) is configured to couple the plug (4) to the plug receptacle (20) and the nozzle (5) to the inlet port (22) based on a movement caused by the linear drive in the unlimited motion mode.

9. The supply device as claimed in claim 1, wherein the detection system (8) is arranged on the movement device (7)

and includes a camera and configured to recognize the position and orientation of the plug receptacle (20) as a recognition feature (28) using an image recognition and evaluation algorithm based on at least two electric plug receptacle contact elements (27) of the plug receptacle (20).

10. The supply device as claimed in claim 1, wherein the joining axis (17) is inclined to the driving surface (18) of the mobile device (2) at an inclination angle (19) in the range from 12° to 32°.

11. A mobile device (2) configured to be supplied by a supply device (1) with a material that can be fed through a supply line (3), the mobile device comprising:

a plug receptacle (20) that extends from a free plug receptacle end along a plug receptacle axis (21) that is configured to be coupled to a plug (4) of the supply device (1) by a linear joining movement (16) of the plug (4) along a joining axis (17), and has at least one electric plug receptacle contact element and at least one recognition feature for a detection system of the supply device (1);

an inlet port (22) with an inlet opening which extends from the inlet port along an inlet port axis (23) and which is configured to be connected to a nozzle (5) of the supply device (1);

an inlet holder (24), which holds the plug receptacle (20) and the inlet port (22) in a defined position and orientation relative to each other such that during coupling of the plug receptacle (20) to the plug (4), the inlet port (22) is adapted to be coupled to the nozzle (5); and the inlet holder is arranged on the mobile device (2) so that the joining axis (17) is inclined in a direction of the joining movement (16) to a driving surface (18) on which the mobile device stands;

wherein the mobile device (2) is configured to detect a coupled state of the plug receptacle (20) with the plug (4) by an electric plug receptacle contact element and based on this, a valve of a supply line (3) of the supply device (1) is adapted to be actuated by the mobile device (2).

12. The mobile device as claimed in claim 11, wherein the inlet holder (24) holds the plug receptacle (20) and the inlet port (22) with parallel alignment of the plug receptacle axis (21) to the inlet port axis (23).

13. The mobile device as claimed in claim 12, wherein the free ends of the plug receptacle (20) and the inlet port (22) are arranged with an offset to each other in the direction of the joining axis (17), and the offset corresponds to an offset in the direction of the joining axis (17) between the free ends of the plug (4) and the nozzle (5) on the supply device (1).

14. The mobile device as claimed in claim 11, wherein at least one locking element for a locking device of the plug (4) of the supply device (1) is arranged on the plug receptacle (20) for locking a coupled state of the plug receptacle (20) with the plug (4) and the valve of the supply line (3) is actuable by the mobile device (2) when the plug is locked.

15. The mobile device as claimed in claim 11, wherein the mobile device (2) is a floor treatment robot.

16. The mobile device as claimed in claim 11, wherein the joining axis (17) is inclined to the driving surface (18) of the mobile device (2) at an inclination angle (19) in the range from 12° to 32°.

17. A system comprising:

a supply device (1) as claimed in claim 1; and a mobile device (2) including, a plug receptacle (20) that extends from a free plug receptacle end along a plug receptacle axis (21) that is configured to be coupled to the plug (4) of the supply device (1) by a linear joining movement (16) of the plug (4) along the joining axis (17), and has at least one electric plug receptacle contact element and at least one recognition feature for a detection system of the supply device (1), an inlet port (22) with an inlet opening which extends from the inlet opening along an inlet port axis (23) and which is configured to be connected to the nozzle (5) of the supply device (1), an inlet holder (24), which holds the plug receptacle (20) and the inlet port (22) in a defined position and orientation relative to each other such that during coupling of the plug receptacle (20) to the plug (4), the inlet port (22) is adapted to be coupled to the nozzle (5), and the inlet holder is arranged on the mobile device (2) so that the joining axis (17) is inclined in a direction of the joining movement (16) to a driving surface (18) on which the mobile device stands, wherein the mobile device (2) is configured to detect a coupled state of the plug receptacle (20) with the plug (4) by an electric plug receptacle contact element and based on this the valve of the supply line (3) of the supply device (1) is adapted to be actuated by the mobile device (2);

wherein the mobile device (2) is supplyable by the supply device (1) with the material that is feedable through the supply line (3) and has a level sensor that provides at least one piece of level information of the feedable material, wherein with the provided level information in a predetermined range the mobile device (2) is autonomously movable to the supply device (1), where the plug (4) of the supply device (1) is moved to the plug receptacle (20) of the mobile device (2), by coupling the plug (4) to the plug receptacle (20) the nozzle (5) is coupled to the inlet port (22), and the valve of the supply line (3) is caused to be actuated by the mobile device (2) based on a detection of the coupled state of the plug receptacle (20) with the plug (4).

* * * * *